US011264717B2

(12) United States Patent
Zhou et al.

(10) Patent No.: US 11,264,717 B2
(45) Date of Patent: Mar. 1, 2022

(54) DUAL-BAND ANTENNA, WIRELESS LOCAL AREA NETWORK DEVICE, AND METHOD FOR MANUFACTURING DUAL-BAND ANTENNA

(71) Applicant: Huawei Technologies Co., Ltd., Shenzhen (CN)

(72) Inventors: Xiao Zhou, Suzhou (CN); Bo Yuan, Suzhou (CN); Xingfeng Jiang, Hod Hasharon (IL); Kun Zhang, Suzhou (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 859 days.

(21) Appl. No.: 16/006,524

(22) Filed: Jun. 12, 2018

(65) Prior Publication Data

US 2018/0358697 A1 Dec. 13, 2018

(30) Foreign Application Priority Data

Jun. 13, 2017 (CN) ..... 201710444068.2

(51) Int. Cl.
*H01Q 5/30* (2015.01)
*H01Q 9/04* (2006.01)
(Continued)

(52) U.S. Cl.
CPC ..... *H01Q 5/30* (2015.01); *H01Q 1/2291* (2013.01); *H01Q 1/36* (2013.01); *H01Q 5/364* (2015.01);
(Continued)

(58) Field of Classification Search
CPC ..... H01Q 5/30; H01Q 9/0421; H01Q 9/0464
See application file for complete search history.

(56) References Cited

U.S. PATENT DOCUMENTS 8,963,793 B2 2/2015 Saliga et al.
9,614,273 B1 * 4/2017 Sena ..... H01Q 9/0421
(Continued)

FOREIGN PATENT DOCUMENTS

CN 2044103 U 9/1989
CN 203225335 U 10/2013
(Continued)

OTHER PUBLICATIONS

Machine Translation and Abstract of Chinese Publication No. CN105428815, Mar. 23, 2016, 5 pages.
(Continued)

*Primary Examiner* — Andrea Lindgren Baltzell
*Assistant Examiner* — Amal Patel
(74) *Attorney, Agent, or Firm* — Conley Rose, P.C.

(57) ABSTRACT

A dual-band antenna, a wireless local area network (WLAN) device, and a method for manufacturing a dual-band antenna, where the dual-band antenna includes a conductive plane, a smooth curved-surface assembly joined onto the conductive plane, and a feed pin connected to the smooth curved-surface assembly. The conductive plane is configured to function as a first antenna, for receiving and sending a radio frequency signal of a first frequency band, and the smooth curved-surface assembly is configured to function as a second antenna, for receiving and sending a radio frequency signal of a second frequency band. Hence, a curved surface of a surface of the curved-surface assembly that is used as the second antenna transits smoothly. Therefore, a current is distributed relatively evenly, and radiation efficiency is relatively high.

21 Claims, 2 Drawing Sheets

(51) Int. Cl.

| | |
|---|---|
| ***H01Q 1/22*** | (2006.01) |
| ***H01Q 5/50*** | (2015.01) |
| ***H01Q 5/364*** | (2015.01) |
| ***H01Q 1/36*** | (2006.01) |
| *H01Q 1/24* | (2006.01) |

(52) U.S. Cl.
CPC ..... *H01Q 5/50* (2015.01); *H01Q 9/0407* (2013.01); *H01Q 9/0421* (2013.01); *H01Q 1/246* (2013.01); *H01Q 9/0464* (2013.01)

(56) References Cited

U.S. PATENT DOCUMENTS

| | | | | |
|---|---|---|---|---|
| 2009/0128442 | A1* | 5/2009 | Fujita | H01Q 1/007 343/860 |
| 2012/0013521 | A1* | 1/2012 | Saliga | H01Q 9/0407 343/860 |
| 2016/0226145 | A1* | 8/2016 | Xu | H01Q 9/0464 |

FOREIGN PATENT DOCUMENTS

| | | | |
|---|---|---|---|
| CN | 103682599 | A | 3/2014 |
| CN | 105428815 | A | 3/2016 |
| CN | 106785456 | A | 5/2017 |
| WO | 2012144247 | A1 | 10/2012 |

OTHER PUBLICATIONS

Machine Translation and Abstract of Chinese Publication No. CN203225335, Oct. 2, 2013, 8 pages.
Machine Translation and Abstract of International Publication No. WO2012144247, Oct. 26, 2012, 51 pages.
Foreign Communication From a Counterpart Application, European Application No. 18176914.2, Extended European Search Report dated Oct. 9, 2018, 8 pages.
Machine Translation and Abstract of Chinese Publication No. CN106785456, May 31, 2017, 6 pages.
Foreign Communication From a Counterpart Application, Chinese Application No. 201710444068.2, Chinese Office Action dated Nov. 5, 2019, pages.

* cited by examiner

DUAL-BAND ANTENNA, WIRELESS LOCAL AREA NETWORK DEVICE, AND METHOD FOR MANUFACTURING DUAL-BAND ANTENNA

CROSS-REFERENCE TO RELATED APPLICATION

This application claims priority to Chinese Patent Application No. 201710444068.2 filed on Jun. 13, 2017, which is hereby incorporated by reference in its entirety.

TECHNICAL FIELD

This application pertains to the field of communications technologies, and relates to a dual-band antenna, a wireless local area network (WLAN) device, and a method for manufacturing a dual-band antenna.

BACKGROUND

The 2.4 gigahertz (GHz) frequency band and the 5 GHz frequency band are two operating frequency bands commonly used in a WLAN. In an indoor environment such as home or an office, a horizontal coverage area of a surface-mounted WLAN device (such as a wireless access point (AP)) is an important performance indicator of the WLAN device. In the Institute of Electrical and Electronics Engineers (IEEE) 802.11b standard, a frequency band of a mobile terminal antenna ranges from 2.4 GHz to 2.4825 GHz and the center frequency is 2.44 GHz. In the IEEE 802.11a standard, an operating frequency band of a mobile terminal antenna ranges from 5.15 GHz to 5.825 GHz and the center frequency is 5.49 GHz. In engineering, −10 decibel (dB) of an antenna is usually used as an operating bandwidth of the antenna. Operating frequency bands are 2.31-2.57 GHz and 4.66-10 GHz, and relative bandwidths are 10.65% and 97%, respectively.

A wide-beam dual-band (or ultra-wideband) antenna may use a surface-mounted cone-shaped antenna. The cone-shaped antenna has an ultra-wideband feature and has an extremely large coverage area when surface-mounted, and is therefore widely used in indoor mobile communication coverage application. A miniaturized low-profile cone-shaped antenna can be easily disposed inside a shell of an AP device. This is extremely important for surface-mounted WLAN coverage in an indoor environment.

The US patent application with the publication No. US20120013521A1 discloses an antenna shown in FIG. 1. The antenna includes a cylindrical surface 14, a horizontal ring 12 that is concentric with the cylindrical surface 14, a pair of short pins 20 and 22 that are symmetrical, a bottom feed plate 28, and a structure for fastening the antenna onto a metal bottom plate. However, antenna efficiency of this structure is relatively low.

SUMMARY

This application provides a dual-band antenna, a WLAN device, and a method for manufacturing a dual-band antenna in order to improve radiation efficiency of the antenna.

According to a first aspect of this application, a dual-band antenna includes a conductive plane, a smooth curved-surface assembly that is joined onto the conductive plane, and a feed pin that is connected to the smooth curved-surface assembly. The conductive plane is configured to function as a first antenna, for receiving and sending a radio frequency signal of a first frequency band, and the smooth curved-surface assembly is configured to function as a second antenna, for receiving and sending a radio frequency signal of a second frequency band. In this solution, a curved surface of a surface of the curved-surface assembly that is used as the second antenna transits smoothly. Therefore, a current is distributed relatively evenly, and radiation efficiency is relatively high.

Optionally, the smooth curved-surface assembly is a curved conical surface, and the curved conical surface is a surface of revolution that uses a two-dimensional curve in a plane perpendicular to the conductive plane as a generatrix.

Optionally, the generatrix of the curved conical surface is determined by an equation $z=H(2x/D)^n$, where n is an order of the symmetrical curved conical surface of revolution and $n>1$, H is a vertical distance from the conductive plane to a bottom of the curved conical surface, D is a diameter of an opening of the curved conical surface, and $x \leq D/2$.

Optionally, the conductive plane is in a ring shape, and an inner diameter of the conductive plane is equal to the diameter of the opening of the curved conical surface.

Optionally, the dual-band antenna further includes a short-circuit plate, where the short-circuit plate is a conductor, and the short-circuit plate is configured to connect the conductive plane to a ground plane.

According to a second aspect of this application, a method for manufacturing a dual-band antenna includes forming a conductive plane that functions as a first antenna, where the conductive plane is used to receive and send a radio frequency signal of a first frequency band, forming a smooth curved-surface assembly that functions as a second antenna and that is joined onto the conductive plane, where the smooth curved-surface assembly is used to receive and send a radio frequency signal of a second frequency band, and forming a feed pin that is connected to the smooth curved-surface assembly. In this solution, the second antenna of the dual-band antenna is the smooth curved-surface assembly. Curvature of a curved surface of the smooth curved-surface assembly changes smoothly, imposing fewer restrictions on ductility of metal during stamping processing. This is favorable for processing.

Optionally, the smooth curved-surface assembly is a curved conical surface, and the curved conical surface is a surface of revolution that uses a two-dimensional curve in a plane perpendicular to the conductive plane as a generatrix.

Optionally, the generatrix of the curved conical surface is determined by an equation $z=H(2x/D)^n$, where n is an order of the symmetrical curved conical surface of revolution and $n>1$, H is a vertical distance from the conductive plane to a bottom of the curved conical surface, D is a diameter of an opening of the curved conical surface, and $x \leq D/2$.

Optionally, the method further includes forming a short-circuit plate, where the short-circuit plate is configured to connect the conductive plane to a ground plane.

Optionally, connecting a feed pin to the smooth curved-surface assembly includes welding the feed pin onto the smooth curved-surface assembly.

Optionally, the dual-band antenna in the foregoing technical solution is a WLAN antenna.

Optionally, the dual-band antenna in the foregoing technical solution may be installed in a WLAN device (for example, a wireless AP).

Optionally, in the foregoing technical solution, the first frequency band is a 2.4 GHz frequency band, and the second frequency band is a 5 GHz frequency band.

Optionally, in the foregoing technical solution, one or more short-circuit plates are joined onto the conductive plane, and the short-circuit plate is configured to connect the conductive plane to a ground plane. For example, the short-circuit plate may be disposed on an edge of the conductive plane to increase short-circuit resistance on the edge of the conductive plane. This can reduce an area of the conductive plane as far as possible, or reduce a resonant frequency of the conductive plane that functions as the first antenna under a same area, thereby improving a bandwidth of the conductive plane that functions as the first antenna.

Optionally, in the foregoing technical solution, two short-circuit plates are joined onto an edge of the conductive plane, and the two short-circuit plates are distributed symmetrically. A manner of joining may include one or more types of screwed joint, key joint, spline coupling, forming connection (or keyless connection), cottering, riveting, welding, cementing, interference fit connection, or the like.

Optionally, in the foregoing technical solution, the feed pin is joined onto a bottom of the smooth curved-surface assembly. A manner of joining may include one or more types of screwed joint, key joint, spline coupling, forming connection, cottering, riveting, welding, cementing, interference fit connection, or the like. When the feed pin is welded onto the smooth curved-surface assembly, processing is easier.

Optionally, in the foregoing technical solution, the feed pin is an inner core of a coaxial cable. A feeding function is implemented using the inner core of the coaxial cable. This can implement good isolation between a feed network and a radiation part. In this way, a feeding part and the radiation part can be designed in a relatively independent manner during design. For a designated mold, a location of a coaxial socket may be determined according to experience, to form good impedance matching.

Optionally, in the foregoing technical solution, the conductive plane may work in a transverse magnetic (TM) mode, for example, a TM02 mode. The smooth curved-surface assembly may function as the second antenna after proper adjustment, for receiving and sending a radio frequency signal in the second frequency band and providing a proper impedance, for example, 50 ohms, for a frequency domain of the second frequency band. For example, a frequency domain of the first frequency band is 2.4 GHz, and a frequency domain of the second frequency band is 5 GHz. Alternatively, a frequency domain of the first frequency band is 5 GHz, and a frequency domain of the second frequency band is 2.4 GHz.

According to a third aspect of this application, a WLAN device includes the dual-band antenna according to any one of the foregoing technical solutions. Optionally, the WLAN device is a wireless AP.

BRIEF DESCRIPTION OF DRAWINGS

To describe the technical solutions in the embodiments of the present disclosure more clearly, the following briefly describes the accompanying drawings required for describing the embodiments.

DESCRIPTION OF EMBODIMENTS

The following clearly describes the technical solutions in the embodiments of the present disclosure with reference to the accompanying drawings in the embodiments of the present disclosure.

Figure 1:
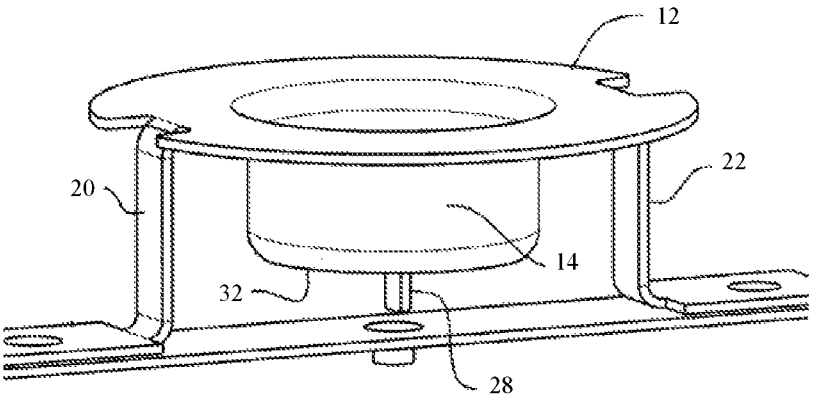
FIG. 1 (PRIOR ART)
FIG. 1 is a schematic structural diagram of a WLAN antenna.

As shown in FIG. 1, a WLAN antenna includes a cylindrical surface 14, a horizontal ring 12 that is concentric with the cylindrical surface 14, a pair of short pins 20 and 22 that are symmetrical, a bottom feed plate 28, and a structure for fastening the antenna onto a metal bottom plate. In this technical solution, there is a 90-degree buckling abrupt structure between a cylindrical bottom surface 32 and the cylindrical surface 14. Therefore, there is a sudden change of a field strength in electromagnetic field distribution near the abrupt structure. This is unfavorable for even distribution of electromagnetic waves, resulting in relatively low antenna efficiency. The bottom feed plate 28 of the antenna is located in a narrow space between the cylindrical bottom surface 32 and the metal bottom plate, and therefore has an extremely low height. This is unfavorable for welding, resulting in great processing difficulties.

Figure 2:
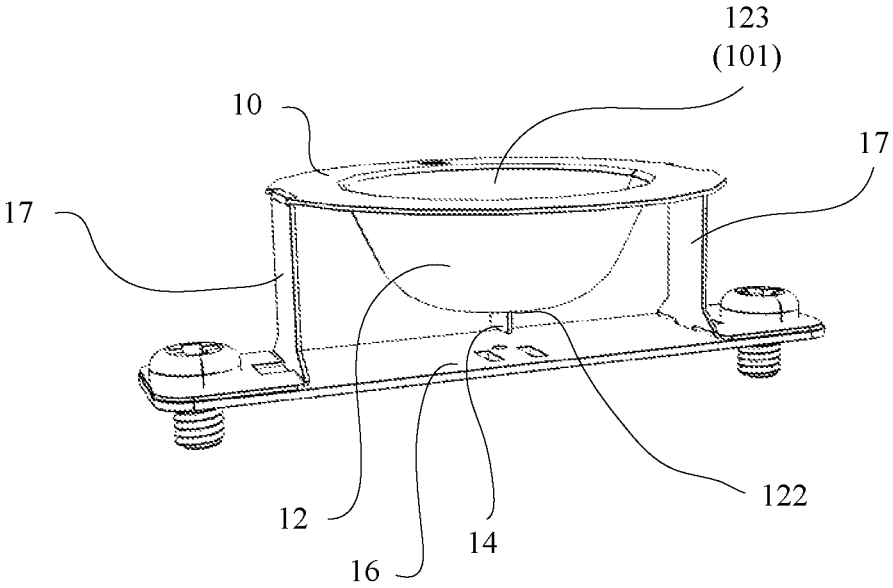
FIG. 2 is a schematic system diagram of a dual-band antenna according to an embodiment of the present disclosure.

As shown in FIG. 2, a dual-band antenna includes a conductive plane 10 and a curved-surface assembly 12 that is joined onto the conductive plane 10. The conductive plane 10 may function as a first antenna after proper adjustment, for receiving and sending a radio frequency signal of a first frequency band (or band). The conductive plane 10 may work in a TM mode, for example, a TM02 mode. The curved-surface assembly 12 may function as a second antenna after proper adjustment, for receiving and sending a radio frequency signal in a second frequency band and providing a proper impedance, for example, 50 ohms, for the second frequency band. For example, the first frequency band is 2.4 GHz, and the second frequency band is 5 GHz. Alternatively, the first frequency band is 5 GHz, and the second frequency band is 2.4 GHz. The conductive plane 10 may be made of metal. The curved-surface assembly 12 is an electrical conductor. For example, the curved-surface assembly 12 may be made of metal.

The conductive plane 10 includes a first hole 101. The curved-surface assembly 12 includes an opening 123 and a second hole 122. The opening 123 corresponds to the first hole 101. Optionally, the opening 123 and the first hole 101 are the same in size and shape. When the conductive plane 10 is joined onto the curved-surface assembly 12, an edge of the opening 123 is aligned with and connected to an edge of the first hole 101. An outer surface of the curved-surface assembly 12 may further be joined onto a feed pin 14.

Optionally, the conductive plane 10 is in a ring shape. The adjustment of the conductive plane 10 includes adjustment of an inner diameter and an outer diameter of the conductive plane. An inner edge of the ring shape is connected to the edge of the first hole 101 of the curved-surface assembly 12.

Optionally, the dual-band antenna may be installed on a ground plane 16. The dual-band antenna and the ground plane 16 are separated, and a side that is of the curved-surface assembly 12 and that is opposite to the conductive plane 10 faces the ground plane 16.

Optionally, one or more short-circuit plates 17 are joined onto the conductive plane 10 of the dual-band antenna, and the short-circuit plate 17 is configured to connect the conductive plane 10 to a ground plane 16. For example, the short-circuit plate 17 may be disposed on an edge of the conductive plane 10 to increase short-circuit resistance on the edge of the conductive plane 10. This can reduce an area of the conductive plane 10 as far as possible, or reduce a resonant frequency of the conductive plane 10 that functions as an antenna under a same area, thereby improving a bandwidth of the conductive plane 10 that functions as an antenna.

Optionally, the short-circuit plate 17 is a metal strip. A first end of the metal strip is joined onto the conductive plane 10, and a second end of the metal strip is joined onto the ground plane 16. Optionally, as shown in FIG. 2, two short-circuit plates 17 are joined onto an edge of the conductive plane 10 of the dual-band antenna, and the two short-circuit plates 17 are distributed symmetrically. Optionally, a manner of joining may include one or more types of screwed joint, key joint, spline coupling, forming connection (or keyless connection), cottering, riveting, welding, cementing, interference fit connection, or the like.

Optionally, the dual-band antenna further includes a feed pin 14, and the feed pin 14 is electrically connected to the curved-surface assembly 12. Optionally, the feed pin 14 is an inner core of a coaxial cable. Generally, an outer conductor of a coaxial line is installed on a back side of a ground plate (for example, a printed circuit board), and a conductor inside the coaxial line is connected to a conductor of the antenna. For a designated antenna mode, a location of a coaxial feed point may be found according to experience in order to generate better matching. A feeding function is implemented using the inner core of the coaxial cable. This can implement good isolation between a feed network and a radiation part. In this way, a feeding part and the radiation part can be designed in a relatively independent manner during design. For a designated mold, a location of a coaxial socket may be determined according to experience to form good impedance matching.

Optionally, the feed pin 14 is electrically connected to the curved-surface assembly 12 at the second hole 122 of the curved-surface assembly 12. Optionally, the feed pin 14 is joined onto a bottom of the curved-surface assembly 12. A manner of joining may include one or more types of screwed joint, key joint, spline coupling, forming connection, cottering, riveting, welding, cementing, interference fit connection, or the like. When the feed pin 14 is welded onto the curved-surface assembly 12, processing is easier.

Figure 3:
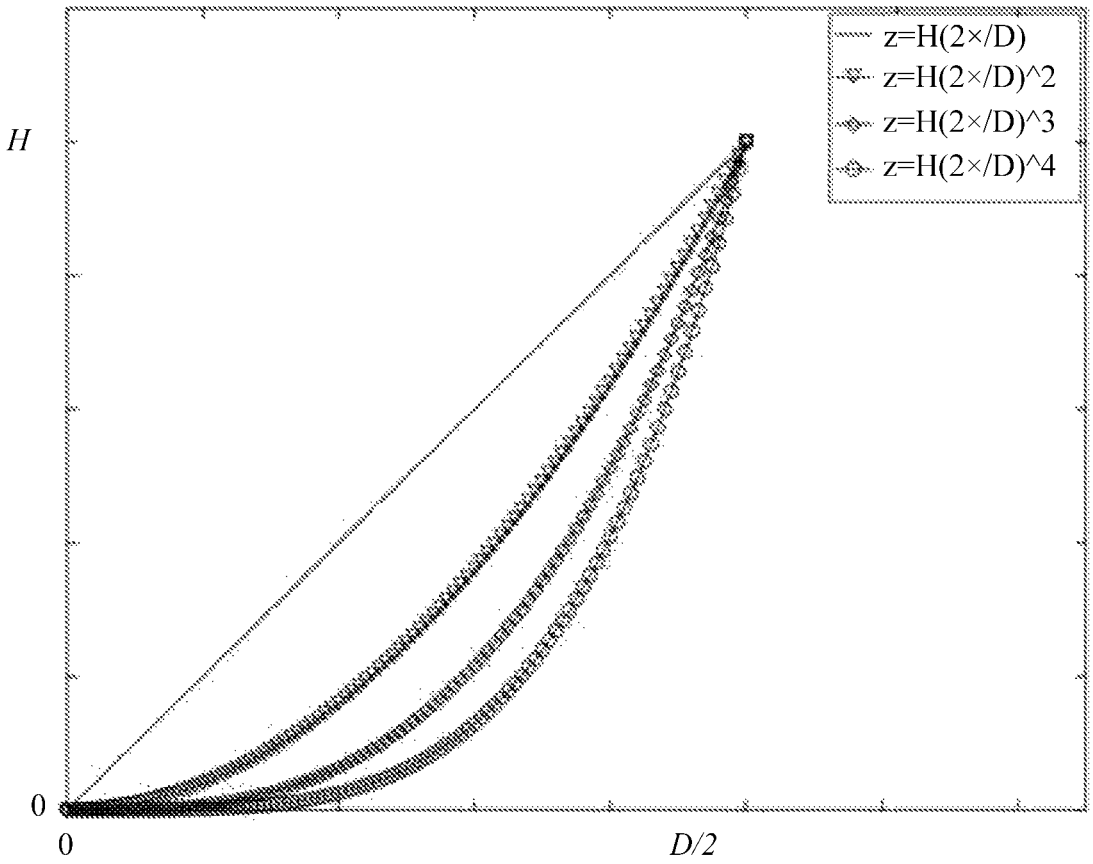
FIG. 3 is a schematic diagram of forming of a symmetrical curved conical surface of revolution according to an embodiment of the present disclosure.

Optionally, the curved-surface assembly 12 may be a curved conical surface. The curved conical surface means a surface of revolution whose shape is similar to a conical frustum. However, the curved conical surface is smooth (for example, the curved conical surface is differentiable everywhere). The first hole 101 and the opening 123 are in a round shape. The curved conical surface is a surface of revolution that uses a two-dimensional curve in a plane perpendicular to the conductive plane 10 as a generatrix. As shown in FIG. 3, in an implementation, the generatrix of the curved conical surface is defined by an equation $z=H(2x/D)^n$, $(0 \le x \le D/2)$. In the equation, n is an order of the generatrix and $n>1$, H is a depth of the symmetrical curved conical surface of revolution, that is, H is a vertical distance from the conductive plane 10 to a bottom of the symmetrical curved conical surface of revolution, D is a diameter of the first hole 101 or the opening 123, and x is any value less than or equal to D/2. An order of the symmetrical curved conical surface of revolution may be regulated by regulating and controlling a value of n. A size of the symmetrical curved conical surface of revolution may be regulated by changing either or both of the diameter D and the depth H. An impedance of the curved-surface assembly 12 that functions as the second antenna may be matched to 50 ohms in the 5 GHz frequency band by regulating one or more of the order n of the conical surface, the diameter D, or the depth H.

If the curved-surface assembly 12 is a circular cone, a circular conical surface is discontinuous at a conical point, a feed point is at the conical point, and a current near the conical point is relatively large. Therefore, there is a relatively large sudden change of an electromagnetic wave from the conical point to the conical surface on the curved-surface assembly 12. If the curved-surface assembly 12 is a cylinder, geometric discontinuity exists on both a bottom surface and a side surface of the cylinder. Therefore, a current is distributed unevenly, and an electromagnetic wave may be reflected at a discontinuous position. However, in this application, 5 GHz frequency band matching design is implemented for the WLAN dual-band antenna of a curved-surface structure using the symmetrical curved conical surface of revolution in this embodiment. A curved surface of a surface of the curved-surface structure transits smoothly. Therefore, a current is distributed relatively evenly, and radiation efficiency is relatively high. Furthermore, in this embodiment of this application, curvature of the curved surface of the WLAN dual-band antenna changes smoothly, imposing fewer restrictions on ductility during metal stamping processing. This is favorable for processing.

Optionally, alternatively, the conductive plane 10 may be in another shape.

Optionally, the dual-band antenna in FIG. 2 may be a WLAN antenna. The dual-band antenna may be installed in a WLAN device, for example, a wireless AP.

Figure 4:
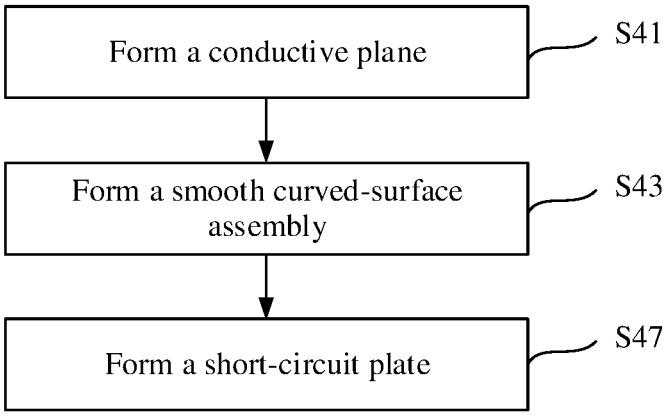
FIG. 4 is a method for manufacturing a dual-band antenna according to an embodiment of the present disclosure.

As shown in FIG. 4, a method for manufacturing the dual-band antenna shown in FIG. 2 includes the following steps.

Step S41. Form a conductive plane that functions as a first antenna, where an area and a shape of the conductive plane may be adjusted for receiving and sending a radio frequency signal of a first frequency band. Optionally, the conductive plane is in a ring shape, and an inner ring of the ring shape is a first hole.

Step S43. Form a smooth curved-surface assembly that functions as a second antenna, where the smooth curved-surface assembly is located below the conductive plane. Optionally, the smooth curved-surface assembly is in a bowl shape, and the smooth curved-surface assembly includes an opening. The opening corresponds to the first hole. Optionally, if the first hole is in a round shape, the opening is in a round shape, and a diameter of the opening is the same as a diameter of the first hole. When the conductive plane and the curved-surface assembly are joined, the first hole matches the opening. The smooth curved-surface assembly further includes a second hole. Optionally, the second hole is located at a bottom of a curved surface and is opposite to the opening. Optionally, a feed pin is welded at the second hole.

Optionally, the conductive plane and the smooth curved-surface assembly in S41 and S43 may also be molded into one piece.

Optionally, the method may further include the following step.

Step S47. Form a short-circuit plate, where the short-circuit plate is configured to electrically connect the dual-band antenna to a ground plane.

Optionally, the method may further include joining a feed pin onto the curved-surface assembly. For example, a second hole is formed on the smooth curved-surface assembly, and the second hole is configured to join the feed pin onto the curved-surface assembly through the second hole. For example, the feed pin is welded onto the second hole at the second hole. For example, the second hole is located at a bottom of the curved-surface assembly. Optionally, the second hole may not be formed on the curved-surface assembly, but the feed pin is welded onto an inner surface or an outer surface of the curved-surface assembly. Optionally, the feed pin may be welded onto the bottom of the curved-surface assembly, opposite to the opening.

The foregoing descriptions are merely example implementations of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A dual-band antenna, comprising:

a conductive plane configured to function as a first antenna for receiving and sending a radio frequency signal of a first frequency band;

a smooth curved-surface assembly coupled to the conductive plane and configured to function as a second antenna for receiving and sending a radio frequency signal of a second frequency band, wherein the smooth curved-surface assembly comprises a curved conical surface, wherein the curved conical surface comprises a surface of revolution using a two-dimensional curve in a plane perpendicular to the conductive plane as a generatrix, wherein the generatrix of the curved conical surface is determined by an equation $z=H(2x/D)^n$, wherein the n comprises an order of a symmetrical curved conical surface of revolution, wherein the $n>1$, wherein the H comprises a vertical distance from the conductive plane to a bottom of the curved conical surface, wherein the D comprises a diameter of an opening of the curved conical surface, and wherein the $x\leq D/2$; and a feed pin coupled to the smooth curved-surface assembly.

2. The dual-band antenna of claim 1, wherein the conductive plane is in a ring shape, and wherein an inner diameter of the conductive plane is equal to the diameter of the opening of the curved conical surface.

3. The dual-band antenna of claim 1, further comprising a short-circuit plate, wherein the short-circuit plate comprises a conductor and is configured to couple the conductive plane to a ground plane.

4. The dual-band antenna of claim 1, wherein the first frequency band comprises a 2.4 gigahertz (GHz) frequency band, and wherein the second frequency band comprises a 5 GHz frequency band.

5. A method for manufacturing a dual-band antenna, comprising:

forming a conductive plane functioning as a first antenna, wherein the conductive plane receives and sends a radio frequency signal of a first frequency band;

forming a smooth curved-surface assembly functioning as a second antenna and coupled to the conductive plane, wherein the smooth curved-surface assembly receives and sends a radio frequency signal of a second frequency band, wherein the smooth curved-surface assembly comprises a curved conical surface, wherein the curved conical surface is a surface of revolution using a two-dimensional curve in a plane perpendicular to the conductive plane as a generatrix, wherein the generatrix of the curved conical surface is determined by an equation $z=H(2x/D)^n$, wherein the n comprises an order of a symmetrical curved conical surface of revolution, wherein the $n>1$, wherein the H comprises a vertical distance from the conductive plane to a bottom of the curved conical surface, wherein the D comprises a diameter of an opening of the curved conical surface, and wherein the $x\leq D/2$; and coupling a feed pin onto the smooth curved-surface assembly.

6. The method of claim 5, further comprising forming a short-circuit plate, wherein the short-circuit plate is configured to couple the conductive plane to a ground plane.

7. The method of claim 5, wherein coupling the feed pin onto the smooth curved-surface assembly comprises welding the feed pin onto the smooth curved-surface assembly.

8. The method of claim 5, wherein the first frequency band comprises a 2.4 gigahertz (GHz) frequency band, and wherein the second frequency band comprises a 5 GHz frequency band.

9. A dual-band antenna, comprising:

a conductive plane configured to function as a first antenna for receiving and sending a radio frequency signal of a first frequency band; and a smooth curved-surface assembly coupled to the conductive plane and configured to function as a second antenna for receiving and sending a radio frequency signal of a second frequency band, wherein the smooth curved-surface assembly comprises a curved conical surface, wherein the curved conical surface comprises a surface of revolution using a two-dimensional curve in a plane perpendicular to the conductive plane as a generatrix, wherein the generatrix of the curved conical surface is determined based on a vertical distance (H) from the conductive plane to a bottom of the curved conical surface and a diameter (D) of an opening of the curved conical surface, wherein the generatrix of the curved conical surface is determined by an equation $z=H(2x/D)^n$, wherein the n comprises an order of a symmetrical curved conical surface of revolution, wherein the $n>1$, and wherein the $x\leq D/2$.

10. The dual-band antenna of claim 9, wherein the first frequency band comprises a 2.4 gigahertz (GHz) frequency band.

11. The dual-band antenna of claim 9, wherein the second frequency band comprises a 5 GHz frequency band.

12. The dual-band antenna of claim 9, wherein the dual-band antenna is a component of a wireless local area network device.

13. The dual-band antenna of claim 12, wherein the component of the wireless local area network device comprises a wireless access point.

14. The dual-band antenna of claim 9, wherein the conductive plane is in a ring shape.

15. The dual-band antenna of claim 14, wherein an inner diameter of the conductive plane is equal to the diameter of the opening of the curved conical surface.

16. The dual-band antenna of claim 9, further comprising a short-circuit plate.

17. The dual-band antenna of claim 16, wherein the short-circuit plate comprises a conductor and is configured to couple the conductive plane to a ground plane.

18. The dual-band antenna of claim 9, further comprising a feed pin coupled to the smooth curved-surface assembly.

19. The dual-band antenna of claim 18, wherein the feed pin is welded onto the smooth curved-surface assembly.

20. The dual-band antenna of claim 18, wherein the feed pin is riveted to the smooth curved-surface assembly.

21. The dual-band antenna of claim 18, wherein the feed pin is screwed onto the smooth curved-surface assembly.

* * * * *